US008091478B1

(12) United States Patent
Khuc et al.

(10) Patent No.: US 8,091,478 B1
(45) Date of Patent: Jan. 10, 2012

(54) SYSTEM AND METHOD FOR ELECTRONICALLY DISCRIMINATING A TARGET

(75) Inventors: Lloyd D. Khuc, Wharton, NJ (US); Barry Schwartz, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 875 days.

(21) Appl. No.: 12/141,277

(22) Filed: Jun. 18, 2008

Related U.S. Application Data

(60) Provisional application No. 61/062,642, filed on Jan. 22, 2008.

(51) Int. Cl.
*F42D 3/00* (2006.01)

(52) U.S. Cl. ..... 102/304; 102/379; 102/275.3

(58) Field of Classification Search ..... 102/304, 102/379, 202–202.14, 275–275.12; 342/136, 342/110, 94, 68
See application file for complete search history.

(56) References Cited

U.S. PATENT DOCUMENTS

2009/0013891 A1* 1/2009 Rastegar et al. ..... 102/210

* cited by examiner

*Primary Examiner* — Timothy A Brainard
(74) *Attorney, Agent, or Firm* — Michael C Sachs

(57) ABSTRACT

A target discrimination system monitors an acceleration switch signal to determine an impact of a projectile on a target. During a sample period of approximately 1.0 milliseconds, the system repeatedly samples the acceleration switch signal, compares the sampled acceleration sensor signal with a reference voltage, and sets a comparator data output to logic one if the sampled signal exceeds the reference voltage. Otherwise, the comparator data output is set to logic zero. The system counts the instances that comparator data output equals logic one during the sample period and executes a selected delay. The selected delay is approximately 50 milliseconds if the counted number of instances exceeds a predetermined threshold of approximately two-thirds of the samples and, otherwise, the selected delay is approximately 10 milliseconds. The selective delay enables target discrimination and selective detonation of a projectile.

17 Claims, 10 Drawing Sheets

SYSTEM AND METHOD FOR ELECTRONICALLY DISCRIMINATING A TARGET

PROVISIONAL APPLICATION

The present application claims benefit under 35 USC 119 (e) of provisional application Ser. No. 61/062,642, filed on Jan. 22, 2008, which is incorporated herein by reference.

U.S. GOVERNMENTAL INTEREST

The inventions described herein may be manufactured, used and licensed by or for the U.S. Government for U.S. Government purposes.

FIELD OF THE INVENTION

The present invention generally relates to a fuze for munitions such as explosive projectiles. More particularly, the present invention relates to using a discriminating timing device to arm and detonate a fuze for an explosive projectile based on detection by the explosive projectile of the target hardness; i.e., the thickness of a wall through which the explosive projectile passes to reach the target at which detonation is desired.

BACKGROUND OF THE INVENTION

Munitions are getting smarter in guidance and in target detection. Conventional high-end munitions currently utilize electronics to detect target impact. These electronics detect that the munition has entered the target, detect voids within the target, and differentiate types of targets.

This target analysis and function mode determination is an important part of optimization of target effects. Conventional electronic systems on these conventional high-end munitions accomplish the optimization of target effects by utilizing on-board microprocessors that monitor accelerometers. The accelerometers comprise a precise weight that loads a piezo device such as a piezoelectric or piezoresistive element upon acceleration. This piezo device generates an electrical signal that the on-board microprocessor can read. The microprocessor uses the generated electrical signal to determine when to function the munition; i.e., when to initiate an explosion of the munition.

Although this technology has proven to be useful, it would be desirable to present additional improvements. The conventional technique for determining target type is, due to cost, currently limited to high-end munitions. The high-cost of the conventional technique is primarily due to the cost of the one or more accelerometers used in target analysis and function mode determination.

Additional conventional bunker munitions use a fixed time delay element in the fuze. The fuze initiates the warhead of the bunker munition some fixed time after impacting a target. The delay time is predetermined for optimal performance against earth and timber bunkers; however, this predetermined delay time is too long for targets such as a building. In some cases, the munition may enter and exit the building before the warhead explodes, rendering the warhead ineffective.

Thus, there is need for a system and method for an electronic target discrimination for a shoulder fired munition. The need for such a system has heretofore remained unsatisfied.

SUMMARY OF THE INVENTION

The present invention satisfies this need, and presents a system and an associated method (collectively referred to herein as "the system" or "the present system") for electronically discriminating a target.

The present system comprises a target discrimination system and a target discrimination module. The target discrimination module monitors a target discrimination circuit to determine an impact of a projectile on a target. During a sample period, the target discrimination module repeatedly samples the output from the target discrimination circuit. The target discrimination circuit compares a filtered acceleration switch signal with a reference signal and sets a comparator data output to a value of 5 volts or a digital logic one if the sampled signal exceeds the reference signal. Otherwise, the target discrimination circuit sets the comparator data output to a value of zero. The target discrimination module counts a number of instances that comparator data output is equivalent to a logic value of one during the sample period. The target discrimination module executes a selected delay comprising a first delay if the counted number of instances exceeds a predetermined threshold, and otherwise, selecting a second delay; the selected delay enables target discrimination and selective detonation of the projectile.

In one embodiment, the sample period comprises approximately 1.0 millisecond. In another embodiment, the first delay comprises approximately 50 milliseconds. In a further embodiment, the second delay comprises approximately 10 milliseconds. In yet another embodiment, the predetermined threshold comprises approximately two-thirds of the counted number of instances The target discrimination circuit comprises an acceleration switch that closes when a projectile impacts a target, enabling the system to detect a target impact. The target discrimination circuit further comprises a low-pass electronic filter to remove a high-resonant frequency from the acceleration switch signal generated at target impact. The target discrimination circuit comprises a comparator for comparing samples of the filtered acceleration switch signal with a reference voltage and generating a comparator data output of a value of approximately 5 volts which equates to digital logic one for each of the samples that exceeds the reference voltage and a value of approximately 0 volt or digital logic zero for each of the samples that falls below the reference voltage. The comparator data output is monitored by the target discrimination module to enable target discrimination.

In one embodiment, the acceleration switch comprises an omni-directional, normally open, spring mass acceleration switch. In another embodiment, the low-pass electronic filter comprises a 1 kHz low-pass electronic filter.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF PREFERRED EMBODIMENTS

The following definitions and explanations provide background information pertaining to the technical field of the present invention, and are intended to facilitate the understanding of the present invention without limiting its scope:

Target Hardness: the resistance a target presents to a projectile. Targets are divided into two main categories, hard and soft. Soft targets are targets that allow the projectile to pass through without significantly deforming the warhead. Both thin walled structures, earth, and timber bunkers are considered soft targets. While both soft targets, a thick-walled target such as earth, timber, and timber bunker present a harder target than a building with thin walls such as plywood.

Figure 1:
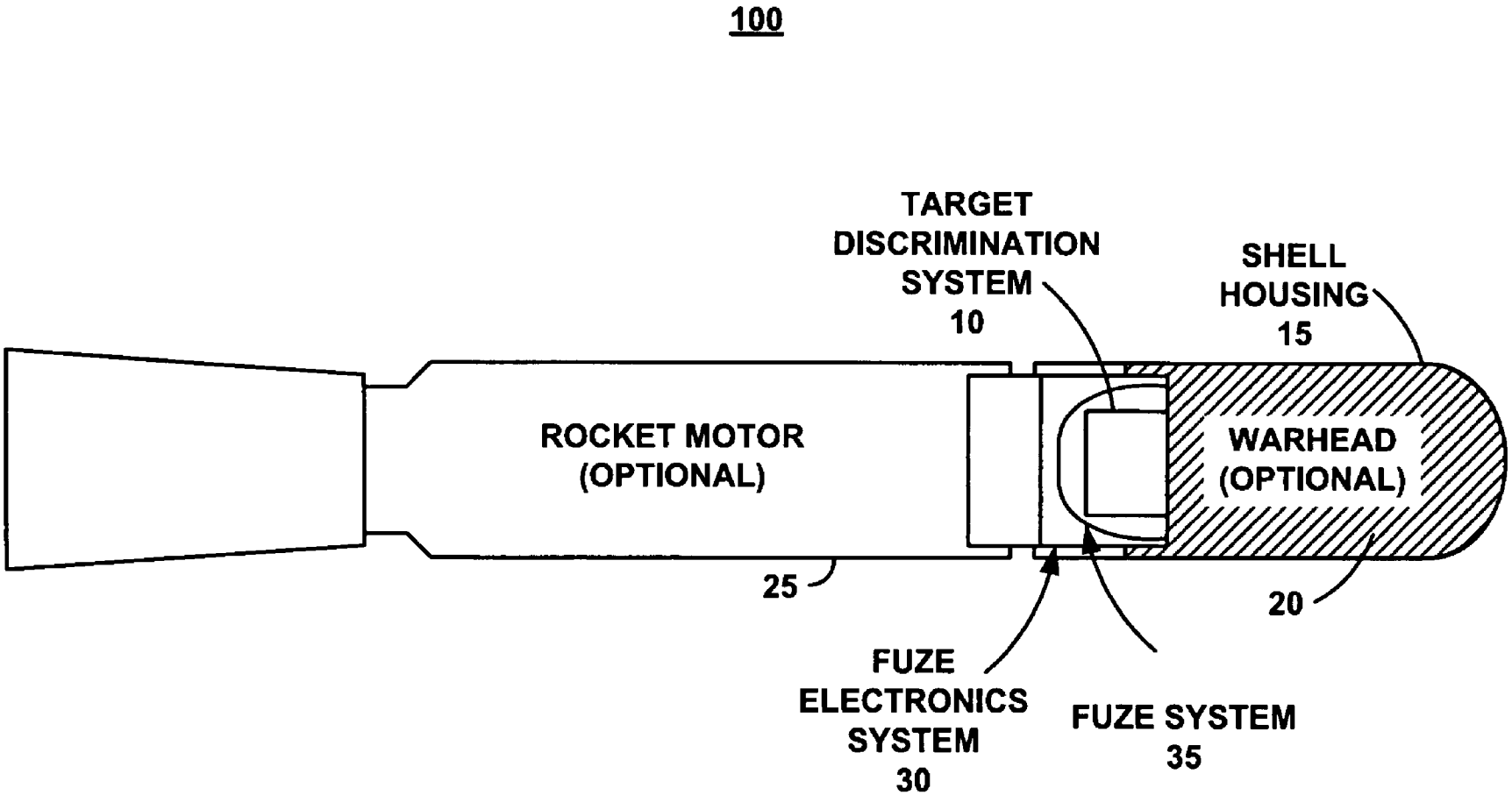
FIG. 1 is a cross-sectional diagram of an exemplary munition in which an electronic target discrimination system of the present invention can be used.

FIG. 1 illustrates a cross-sectional diagram of an exemplary projectile 100 in which a system, a computer product, an electronic product, and an associated method (the target discrimination system 10, or "system 10") can be used. Projectile 100 further comprises a shell housing 15, an optional warhead 20 comprising an explosive, an optional rocket motor 25, a fuze electronics system 30 and a fuze system 35. The fuze system 35 keeps the warhead safe until projectile 100 is launched. The fuze system 35 then arms and detonates warhead 20 as directed by systems 10 and 30.

System 10 determines a target hardness and thereby the target type, then relays this information to fuze system 30, which appropriately detonates the munition in response to the determined target hardness. For exemplary purposes only, the target hardness is alternatively referenced herein as thickness of a target wall or type of target; i.e., a target comprising thick walls such as a earth and timber bunker or a target comprising thin walls such as a building. System 10 determines target hardness based on an acceleration sensor signal registered at impact of the target by projectile 100. System 30 delays detonation in response to the target hardness as determined by system 10, selecting a longer delay for targets with thick walls and a shorter delay for targets with thin walls. System 10 also continually monitors the crush switch 200 for closure, indicating the warhead is crushing on rather than penetrating the target. In such a case, system 10 initiates a short delay, only enough to allow the front of the warhead to conform to and spread out on the target, then commands system 30 to detonate the warhead 20.

Figure 2:
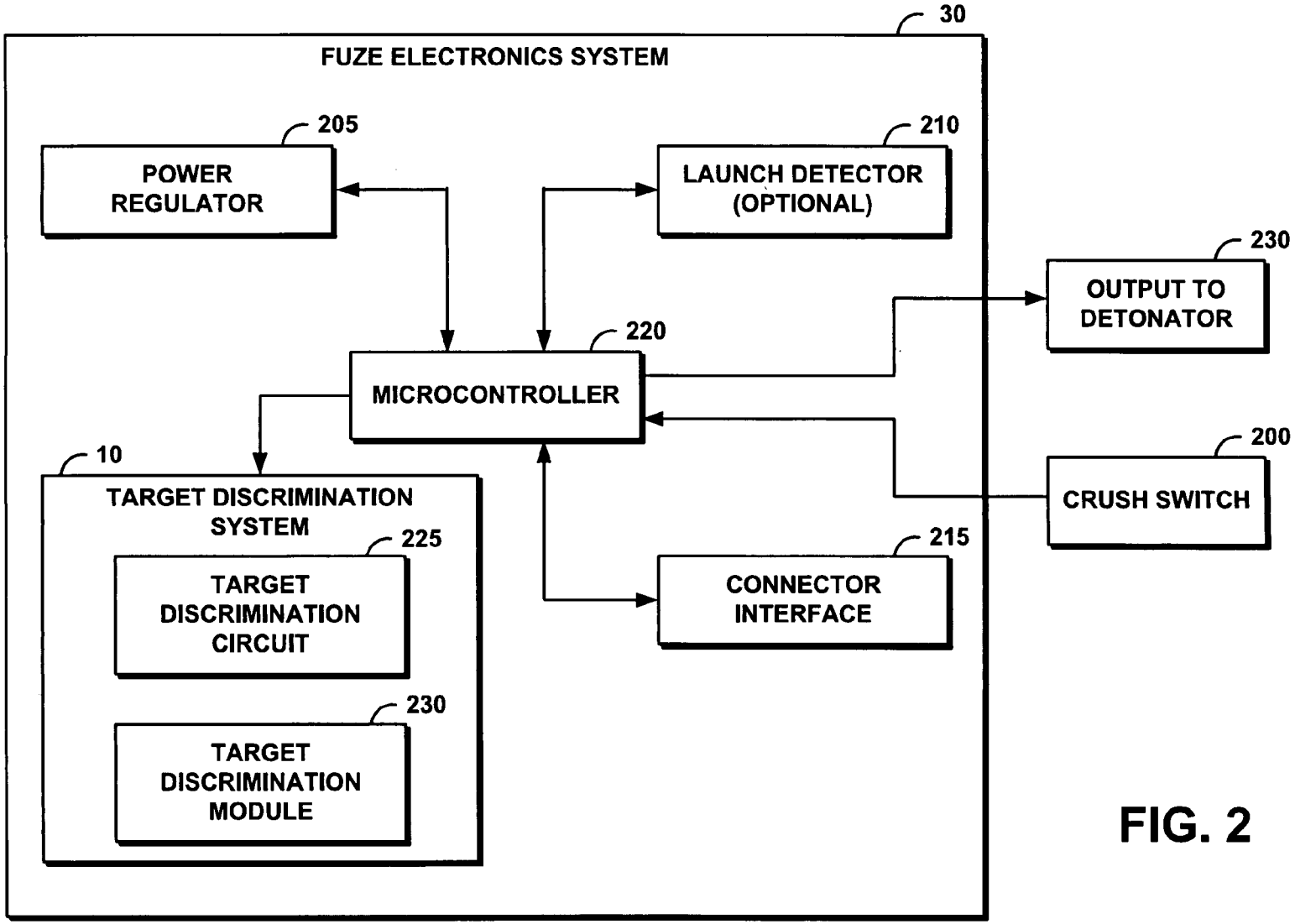
FIG. 2 is a block diagram of the high-level architecture of a fuze electronics system utilizing the electronic target discrimination system of FIG. 1.

On impact, system 10 initiates a timer based on a comparison between data measured by system 10 and data stored in system 10. Based on the comparison of the measured data and the stored data, system 10 determines target hardness. System 10 selects a timer delay based on the determined target hardness. Warhead 20 is detonated when the selected timer delay has expired FIG. 2 illustrates a high-level architecture of the fuze electronics system 30. The fuze electronics system 30 comprises system 10, a crush switch 200, a power regulator 205, an optional launch detector 210, a connector interface 215, and a microcontroller 220. The fuze electronics system 30 produces an output to a detonator 230. System 10 comprises a target discrimination circuit 225 and a target discrimination module 230. The target discrimination module 230 comprises logic for discriminating target hardness based on output from the target discrimination circuit 225. In one embodiment, the logic of the target discrimination module 230 is stored on microcontroller 220. Alternatively, the logic of the target discrimination module 230 may be hardware or software on any integrated or discrete circuitry, or may comprise a similar analog logic with associated hardware.

Figure 3A:
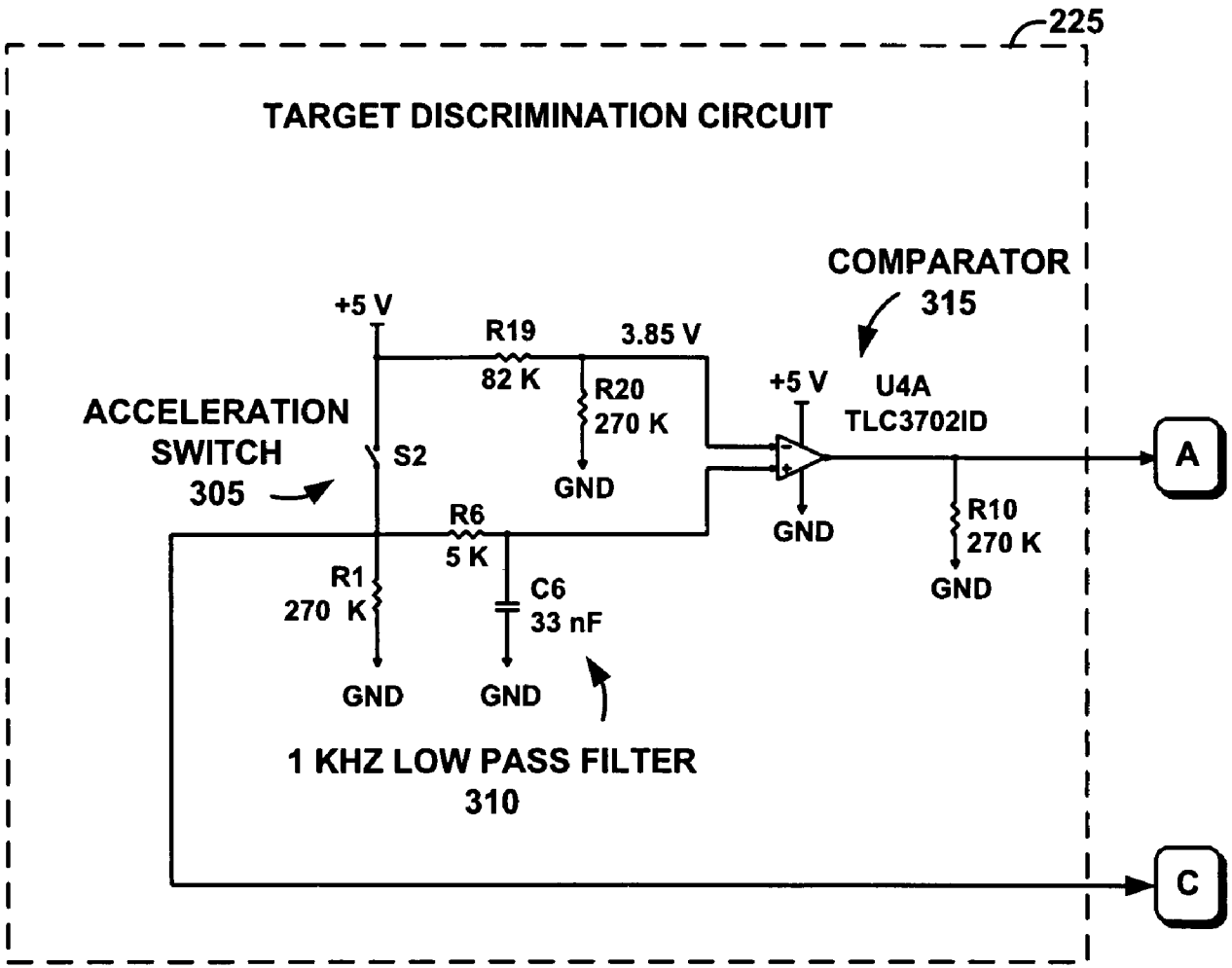
FIG. 3 is comprised of FIGS. 3A, 3B, and 3C, and represents a diagram of an exemplary electronic circuit of the fuze electronic system utilizing the electronic target discrimination system of FIGS. 1 and 2.
Figure 3B:
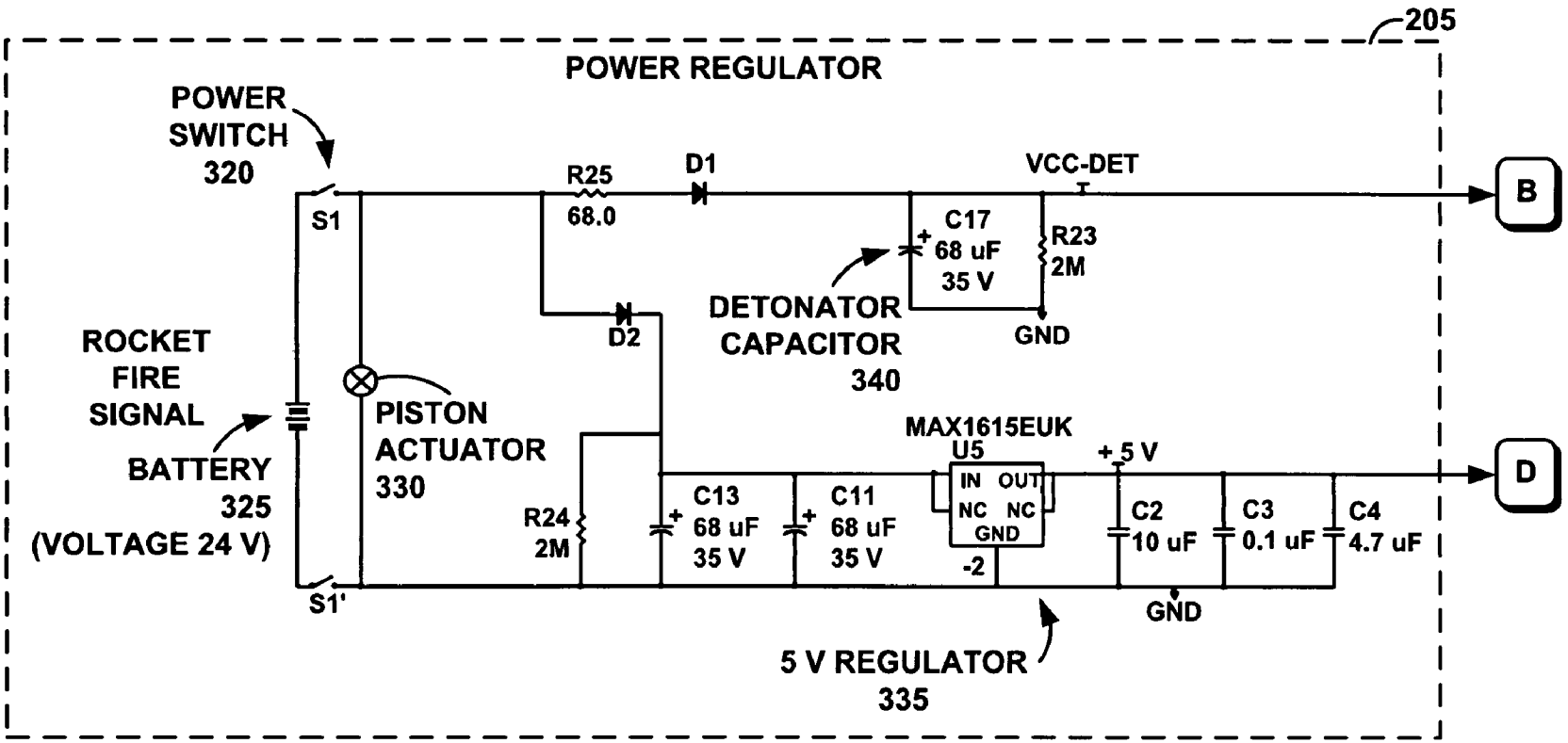
Figure 3C:
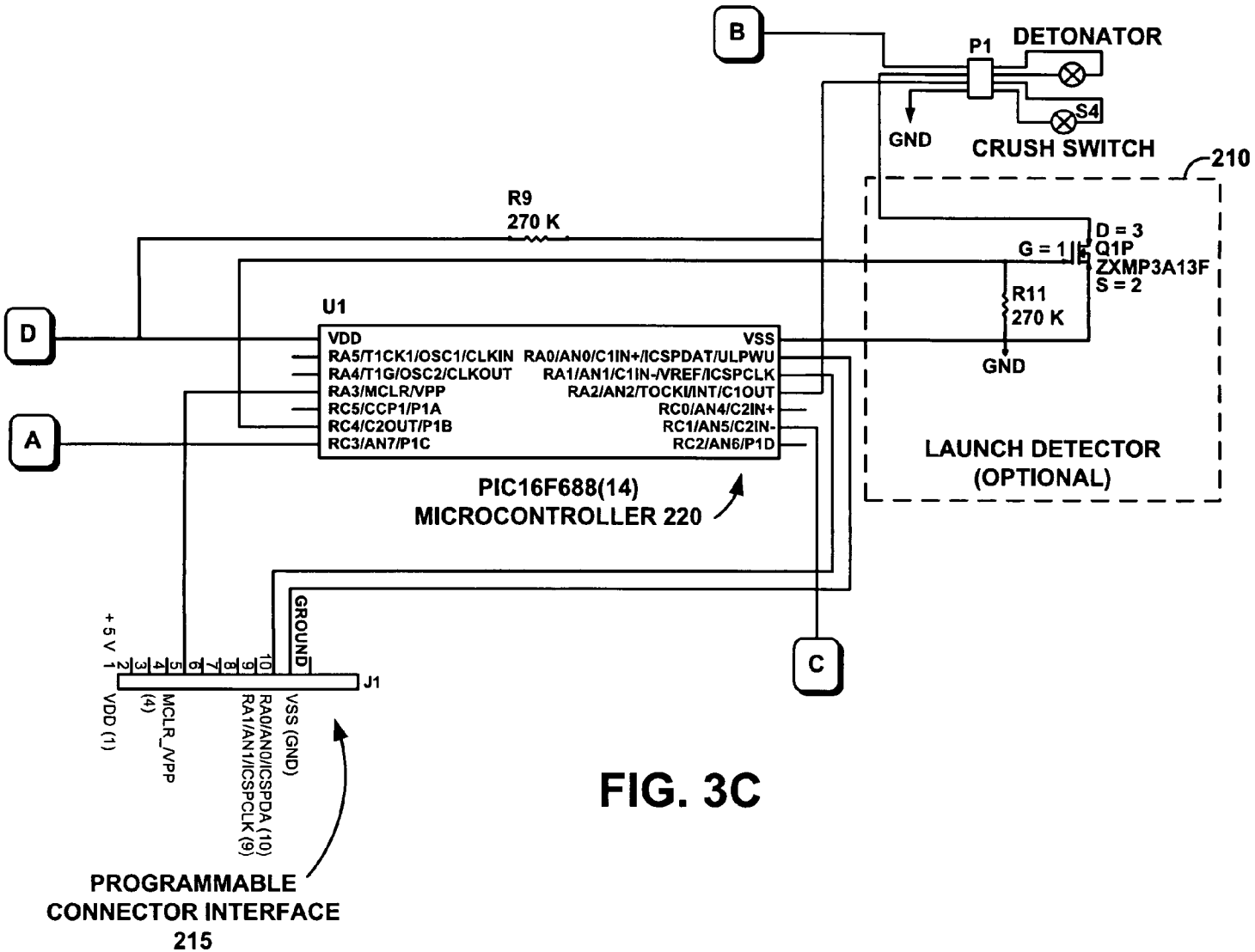

FIG. 3 (FIGS. 3A, 3B, 3C) illustrates an exemplary circuit diagram of the fuze electronics system 30 and the target discrimination circuit 225. The target discrimination circuit 225 comprises an acceleration switch 305, a 1 kHz low-pass electronic filter 310, and a comparator 315. System 10 may be used with any type of acceleration switch. In one embodiment, the acceleration switch 305 comprises an omni-directional, normally open, spring mass acceleration switch.

The 1 kHz low-pass electronic filter 310 removes high resonant frequency from an accelerometer switch signal generated on impact with the target. While a 1 kHz low-pass electronic filter is used for illustrative purposes only, it should be clear that any analog or digital low-pass filter may be used, depending on the specific application of system 10.

The power regulator 205 comprises a power switch 320, a battery 325, a piston actuator 330, a 5 V regulator 335, and a detonator capacitor 340. The battery 325 provides a voltage of 24 V. The 5 V regulator 335 drops the voltage to 5 V. In one embodiment, a capacitor is used as a power source, providing the voltage of 24 V. Upon launch of projectile 100, the capacitor is charged with sufficient energy to last the duration of the flight of projectile 100.

The launch detector 210 (optional) detects the launch initiation of projectile 100. In one embodiment the acceleration switch 305 closes on launch and is used as a launch detector 210. An alternative embodiment according to the present invention comprises a capacitor as power source, energizing the capacitor may function as indicator of launch initiation.

Microcontroller 220 comprises a commercially available microcontroller such as, for example, a PIC16F688(14) microcontroller. In one embodiment, the target discrimination module 230 is stored on microcontroller 220. Alternatively, the target discrimination module 230 may be hardware or software on any integrated or discrete circuitry, or may comprise a similar analog logic with associated hardware.

Figure 4A:
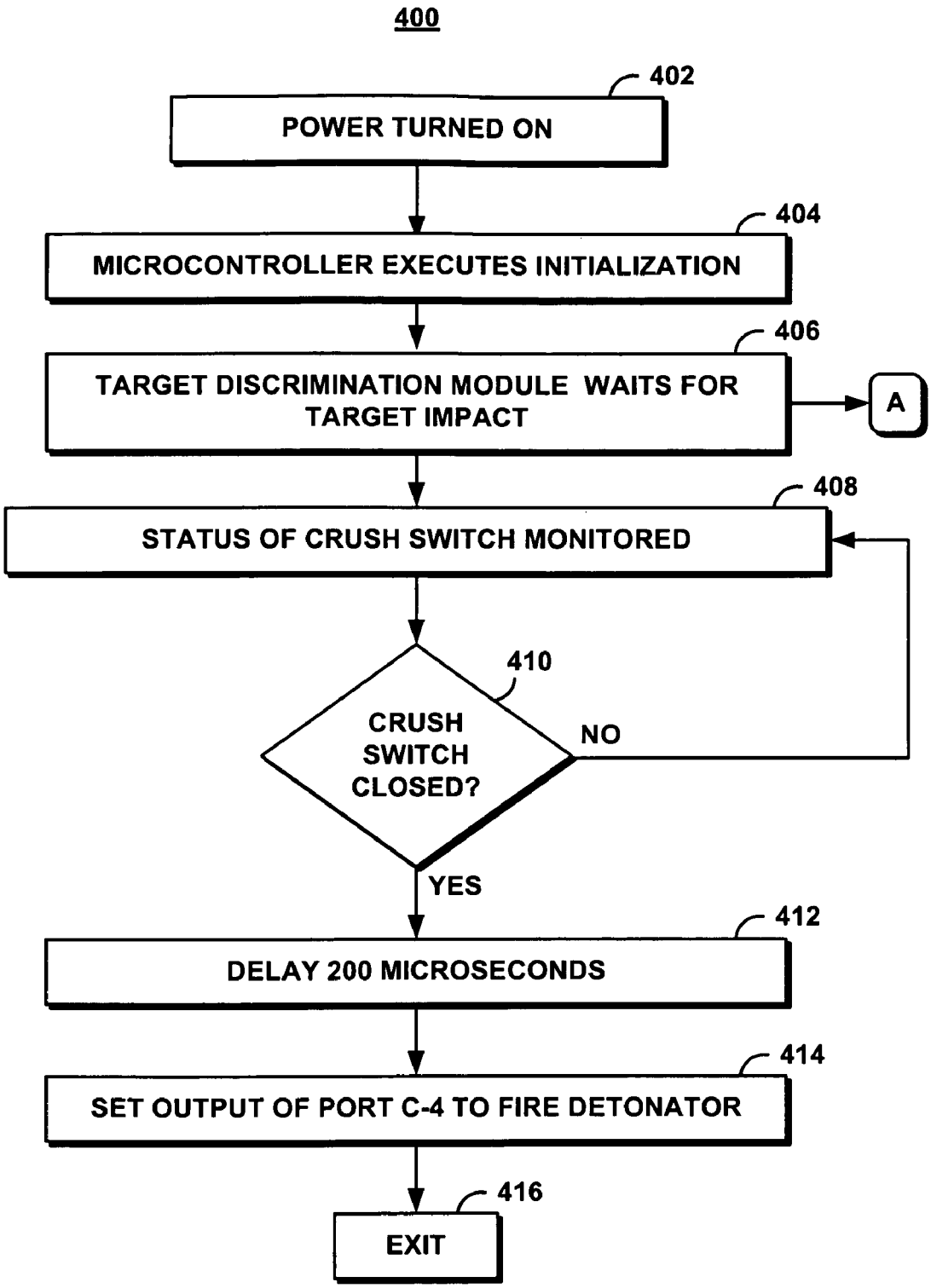
FIG. 4 is a process flow chart illustrating a method of operation of the electronic target discrimination system of FIGS. 1 and 2.
Figure 4B:
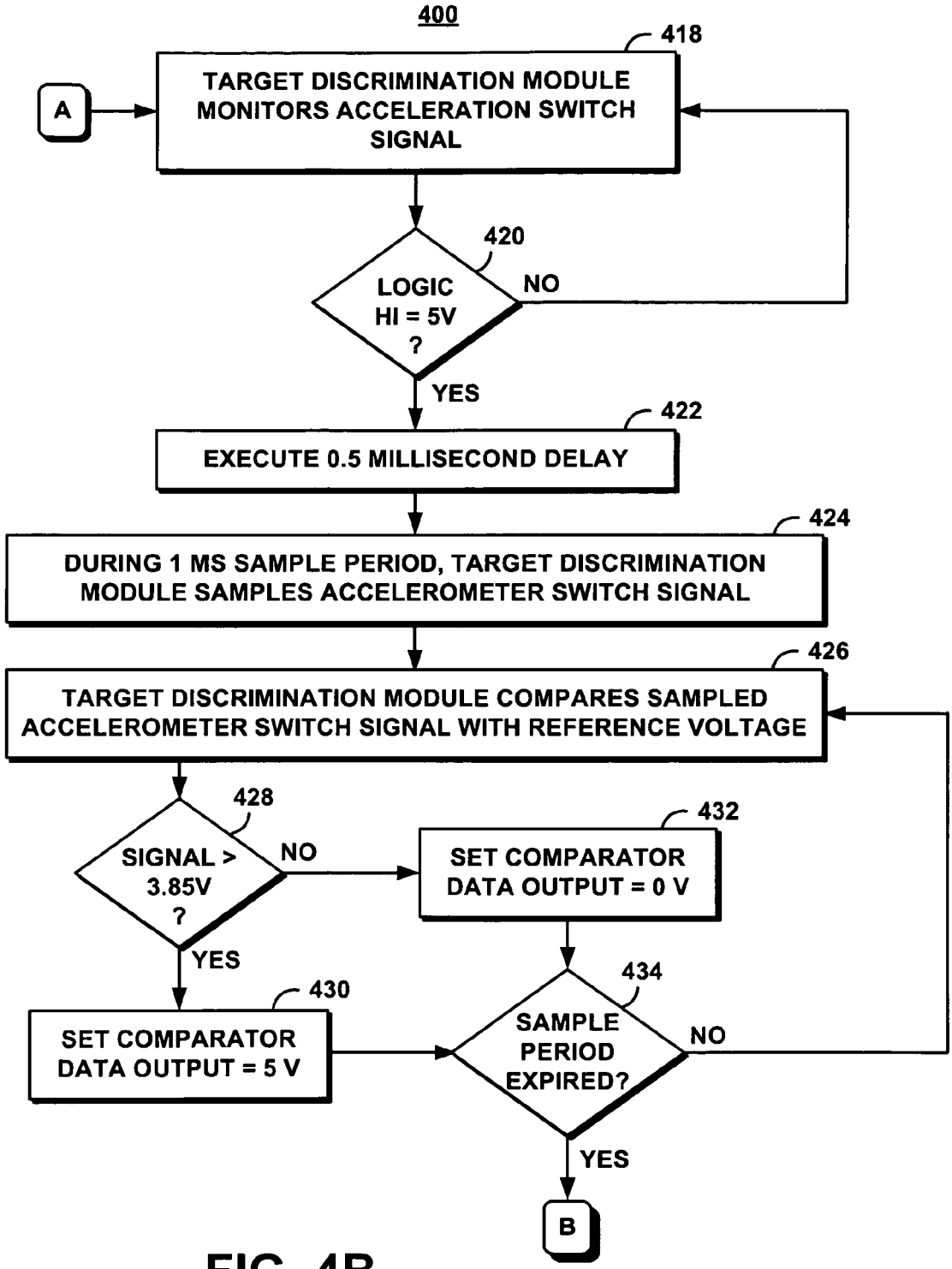
Figure 4C:
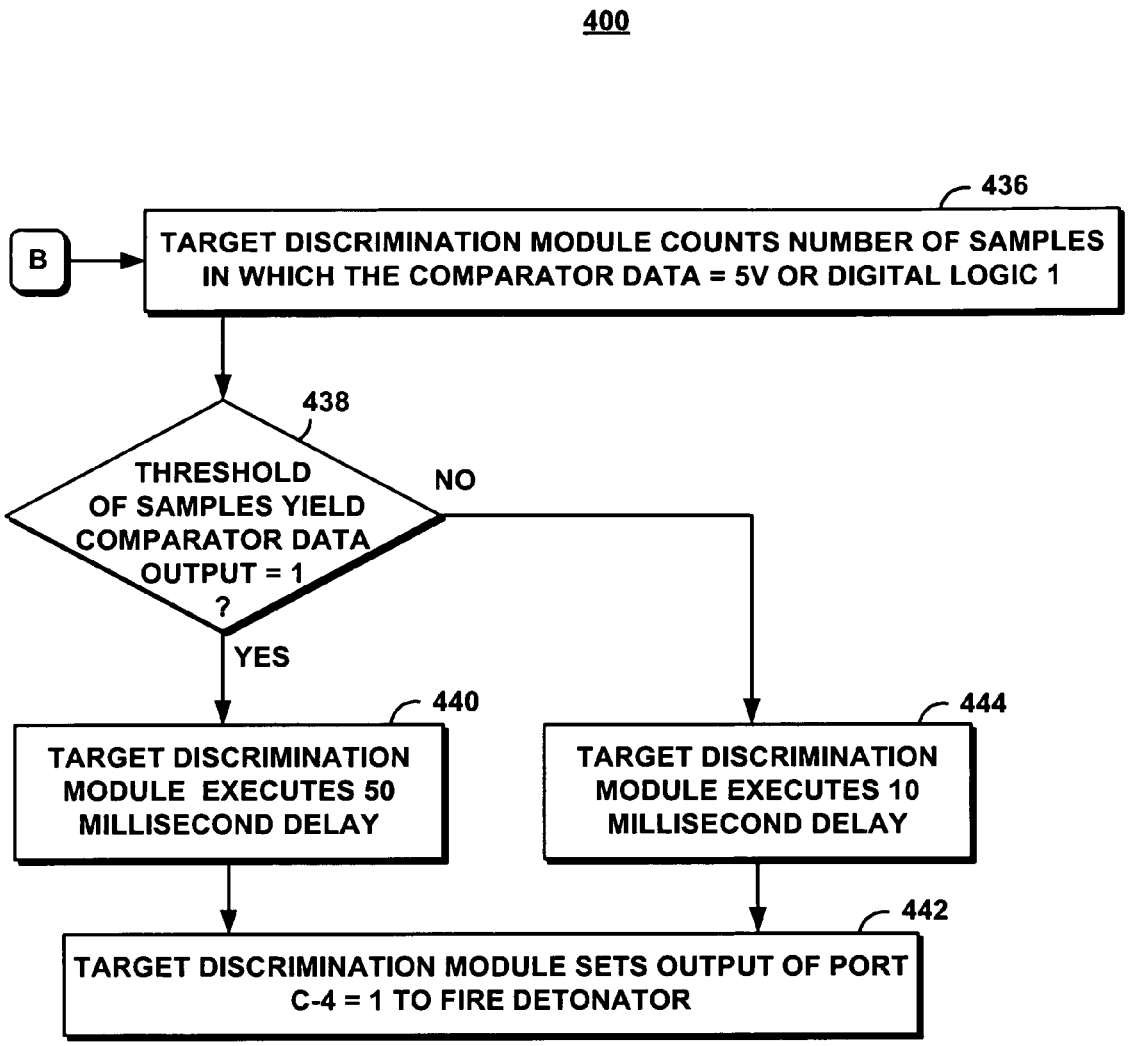

FIG. 4 illustrates a method 400 of system 10 in discriminating target hardness. Power to the fuze electronics system 30 is turned on (step 402). Step 402 may be accomplished by activating the power switch 320. In one embodiment, step 402 is accomplished by charging a capacitor. Microcontroller 220 executes initialization (step 404). During initialization, before projectile 100 impacts the target, the acceleration switch 305 is normally open. Input of the comparator 315 is connected to circuit ground through a resistor. A reference voltage of comparator 315 is preset to 3.85 volts. An input of zero volts to comparator 315 produces an output in a logic low state (0 volts) prior to target impact.

The target discrimination module 230 waits for target impact (step 406). The target discrimination module 230 monitors a status of a crush switch (step 408); closure of the crush switch overrides the acceleration switch 305. If the crush switch is closed (decision step 410), the target discrimination module 230 executes a delay of 200 microseconds (step 412). The target discrimination module 230 sets the output of a port C-4 of the microcontroller equal to logic 1 to fire a detonator of the projectile (step 414) The target discrimination module 230 exits processing (step 416).

The target discrimination module 230 monitors an acceleration switch signal generated by system 225 (step 418). On impact with the target, the acceleration switch 305 closes, applying the regulated 5-volt signal equivalent to logic 1 to port C-1 of the microcontroller. This is the initial indication to that projectile 100 has impacted the target.

On detection of the logic high of 5 volts, the target discrimination module 230 executes a 0.5 millisecond delay (step 422). After the 0.5 millisecond delay, the target discrimination module 230 takes sample readings of the output of comparator 315 during a sample period of predetermined time such as, for example, 1.0 milliseconds (step 424). In one embodiment, a system clock of microcontroller 220 operates at a frequency of 1 MHz, enabling the target discrimination module 230 to perform 50 samples during the sample period.

According to another embodiment, a system clock of micro controller 220 operates at a frequency of 250 KHz, enabling the target discrimination module 230 to perform 13 samples during the sample period.

For each sample, the target discrimination module 230 records the output from the target discrimination circuit comparator 315 which compares the filtered acceleration switch signal with the reference voltage of comparator 315 (step 426). If the signal is greater than the reference voltage of comparator 315 (i.e., greater than 3.85 V) (decision step 428), the comparator 315 sets its data output equal to 5 volt or digital logic one (step 430). Otherwise, the filtered acceleration switch signal is less than the reference voltage of comparator 315 and the comparator 315 sets its data output equal to 0 volt or digital logic zero (step 432). If the sample period has not expired (decision step 434), processing returns to step 426 and repeats steps 426 through 434 until the sample period has expired.

After the sample period has expired, the target discrimination module 230 counts the number of samples in which the comparator data is equal to logic one (step 436). If a predetermined threshold of the samples yield comparator data output of 5 volts or digital logic one (decision step 438), the target comprises thick walls such as those of a earth and timber bunker. In one embodiment, the threshold of samples is two thirds. The target discrimination module 230 executes a selective delay comprising a 50 millisecond delay (step 440). The target discrimination module 230 sets the output of port C-4 equal to logic one to fire the detonator (step 442). If at decision step 438 the predetermined threshold of samples of comparator data output of logic one is not met, the target comprises thin walls such as that of a building. The target discrimination module 230 executes a selective delay comprising a 10 millisecond delay (step 444) and sets the output of port C-4 equal to logic one to fire the detonator (step 442). The selective delay enables target discrimination and selective detonation of projectile 100.

Figure 5:
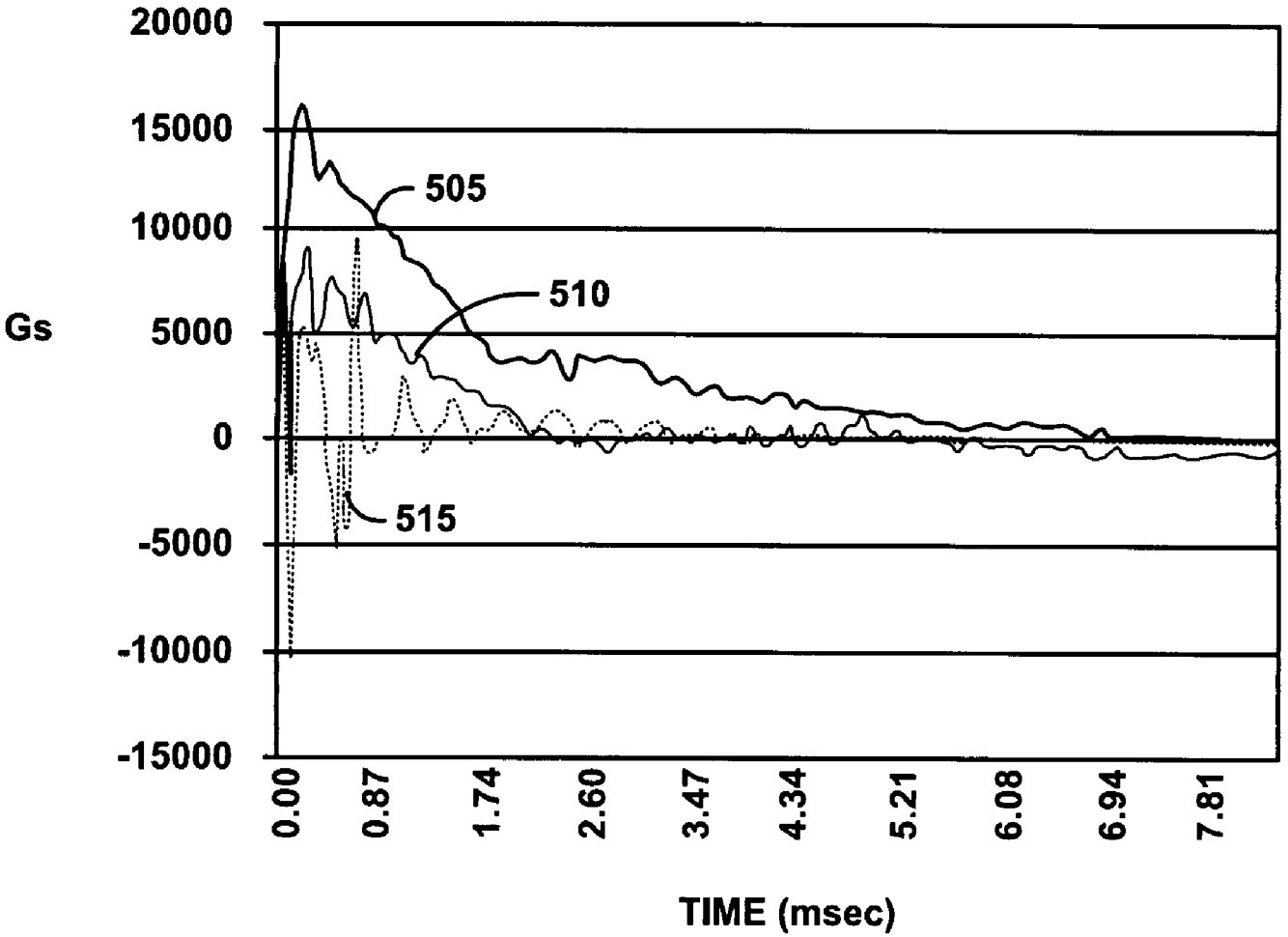
FIG. 5 is a graph illustrating typical acceleration signal data monitored and analyzed by the electronic target discrimination system of FIGS. 1 and 2 to discriminate the target.

FIG. 5 illustrates typical acceleration profiles measured by system XX during target impacts. A waveform 505 and a waveform 510 represent acceleration data measured when projectile 100 impacts a harder target such as a earth and timber bunker. A waveform 515 represents an acceleration data measured when the projectile 100 impacts a softer target such as a building with plywood walls. Upon target impact, system 10 samples the output of the target discrimination circuit caused by the waveform of the acceleration profile and compares the sample with the predetermined comparator reference voltage of 3.85 V over a predetermined sample period. The waveform of the acceleration switch signal for impact with a earth and timber bunker is a low frequency waveform, yielding a high percentage of samples over 3.85 V, yielding in turn a high percentage of comparator data outputs of value 5 volts or equal to digital logic one.

In contrast, waveform 515 is a high frequency waveform that decays faster than the acceleration switch signal generated on impact with a earth and timber bunker. Consequently, a lower percentage of samples yields comparator data outputs of value logic 1. While the predetermined threshold of the number of samples that yield comparator data output of value 5 volts or equal to digital logic one is determined through test data, it should be clear that any appropriate method for specifying the predetermined threshold may be used.

Figure 6:
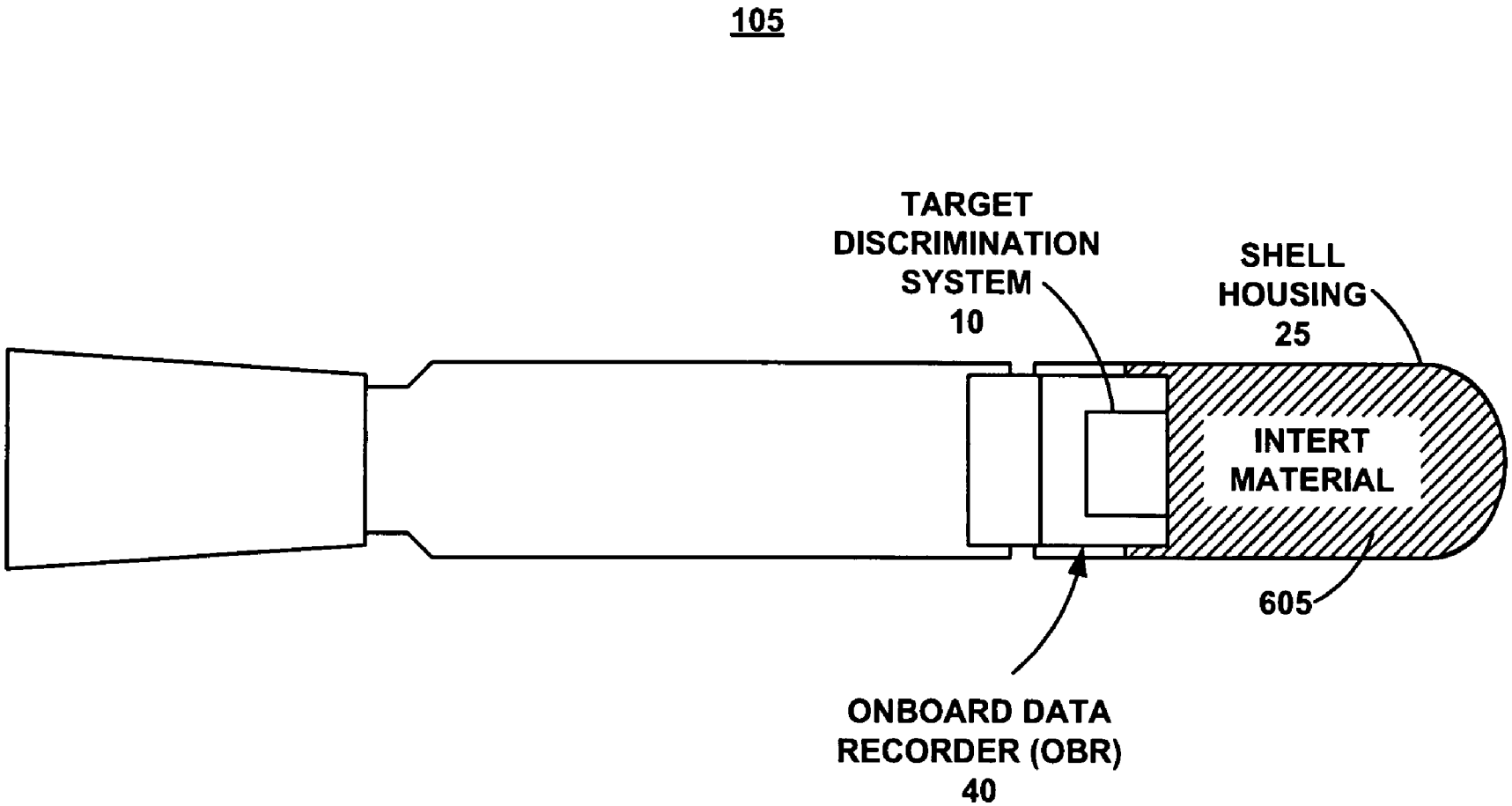
FIG. 6 is a cross-sectional diagram of one embodiment of the electronic target discrimination system utilized in determining the effectiveness of the exemplary target discrimination system

FIG. 6 illustrates a cross-sectional diagram of one embodiment of the electronic discrimination system utilized in determining the effectiveness of the target discrimination system 10. In this embodiment, the projectile comprises an inert material 605 in the shell housing 25. In this embodiment, an onboard data recorder 40 was used to record the output of system 10 when the projectile 105 was fired into various targets. The projectile 105 was then recovered and the recorder 40 was played back to determine if the exemplary target discrimination system 10 recorded the correct target.

It is to be understood that the specific embodiments of the invention that have been described are merely illustrative of certain applications of the principle of the present invention. Numerous modifications may be made to the system and method for electronically discriminating a target as described herein without departing from the spirit and scope of the present invention.

What is claimed is:

1. A processor-implemented method of electronically discriminating a target, comprising:

monitoring an acceleration switch signal to determine an impact of a projectile on a target;

during a sample period, repeatedly sampling the acceleration switch signal;

comparing the sampled acceleration switch signal with a reference voltage and setting a comparator data output to a predetermined value if the sampled acceleration switch signal exceeds the reference voltage and, otherwise, setting the comparator data output to a value of digital logic zero;

counting a number of instances that comparator data output is equivalent to the predetermined value during the sample period; and executing a selected delay comprising a first delay if the counted number of instances exceeds a predetermined threshold and, otherwise, comprising a second delay; the selected delay enables target discrimination and selective detonation of the projectile.

2. The method of claim 1, wherein the sample period comprises approximately 1.0 milliseconds.

3. The method of claim 1, wherein the first delay comprises approximately 50 milliseconds.

4. The method of claim 1, wherein the second delay comprises approximately 10 milliseconds.

5. The method of claim 1, wherein the predetermined threshold comprises approximately two-thirds of the counted number of instances.

6. The method of claim 1, wherein the reference voltage is approximately 3.85 V.

7. The method of claim 1, wherein the predetermined value is a predetermined voltage value.

8. The method of claim 7, wherein the predetermined value is 5 volts.

9. The method of claim 1, wherein the predetermined value is a digital logic value.

10. The method of claim 9, wherein the digital logic value is 1.

11. A system for electronically discriminating a target, comprising:

an acceleration switch that closes when a projectile impacts a target, enabling the system to detect a target impact;

a low-pass electronic filter to remove a high-resonant frequency from an accelerometer sensor signal generated at target impact; and a comparator for comparing a plurality of samples of the accelerometer sensor signal with a reference voltage and generating a comparator data output of a predetermined value for each of the samples that exceed the reference voltage and a value of digital logic zero for each of the samples that falls below the reference voltage; wherein, the comparator data output is counted to enable target discrimination.

12. The system of claim 11, wherein the acceleration switch comprises an omni-directional, normally open, spring mass acceleration switch.

13. The system of claim 11, wherein the low-pass electronic filter comprises a 1 kHz low-pass electronic filter.

14. The system of claim 11, wherein the predetermined value is a predetermined voltage value.

15. The system of claim 14, wherein the predetermined value is 5 volts.

16. The system of claim 11, wherein the predetermined value is a digital logic value.

17. The system of claim 16, wherein the digital logic value is 1.

* * * * *